US010370745B2

(12) United States Patent
Pan et al.

(10) Patent No.: US 10,370,745 B2
(45) Date of Patent: Aug. 6, 2019

(54) MAGNESIUM-ZINC-MANGANESE-TIN-YTTRIUM ALLOY AND METHOD FOR MAKING THE SAME

(71) Applicant: The Boeing Company, Chicago, IL (US)

(72) Inventors: Fusheng Pan, Chongqing (CN); Dingfei Zhang, Chongqing (CN); Guangshan Hu, Chongqing (CN); Xia Shen, Chongqing (CN); Jingren Dong, Chongqing (CN); Sensen Chai, Chongqing (CN); Daliang Yu, Chongqing (CN); Fei Guo, Chongqing (CN); Luyao Jiang, Chongqing (CN)

(73) Assignee: The Boeing Company, Chicago, IL (US)

( * ) Notice: Subject to any disclaimer, the term of this patent is extended or adjusted under 35 U.S.C. 154(b) by 326 days.

(21) Appl. No.: 14/449,449

(22) Filed: Aug. 1, 2014

(65) Prior Publication Data

US 2016/0032428 A1 Feb. 4, 2016

(51) Int. Cl.

| | |
|---|---|
| ***C22C 23/04*** | (2006.01) |
| ***C22F 1/06*** | (2006.01) |
| ***B21C 23/00*** | (2006.01) |

(52) U.S. Cl.

CPC ..... *C22C 23/04* (2013.01); *B21C 23/002* (2013.01); *C22F 1/06* (2013.01)

(58) Field of Classification Search

CPC ..... C22C 21/10; C22F 1/053; C22F 1/047
USPC ..... 148/402, 420, 557
See application file for complete search history.

(56) References Cited

U.S. PATENT DOCUMENTS

2008/0317621 A1* 12/2008 Aoki ..... C22C 1/02 420/402

FOREIGN PATENT DOCUMENTS

| | | | |
|---|---|---|---|
| CN | 101020981 A | | 8/2007 |
| CN | 102230118 B | | 6/2012 |
| CN | 103290285 A | | 9/2013 |
| JP | 2003126943 A | * | 5/2003 |

OTHER PUBLICATIONS

NPL: Machine translation of JP 2003126943A, May 2003.*
NPL-1: Sasaki et al, Heat-treatable Mg—Sn—Zn wrought alloy, Scripts Materialia 61 (2009) pp. 80-83 (Year: 2009).*
NPL-2: Zhanget al., Microstructures and mechanical properties of high strength Mg—Zn—Mn alloy, Trans. Nonferrous Met. Soc. China 18 (2008) pp. s59-s63. (Year: 2008).*
NPL-3: Gorny et al, High temperature phase stabilized microstructure in Mg—Zn—Sn alloy with Y and Sb additions, J. Mater. Sci. (2007) 42, pp. 10014-10022. (Year: 2007).*
Zhang DF, Shi GL, Dai QW, et al. "Microstructures and mechanical properties of high strength mg—zn—mn alloy," *NonferrMetal Soc*, 2008, 18(Spec. Issue 1): s59-s63.

(Continued)

*Primary Examiner* — Jie Yang
(74) *Attorney, Agent, or Firm* — Walters & Wasylyna LLC

(57) ABSTRACT

A magnesium alloy including about 2 percent by weight to about 8 percent by weight zinc, about 0.1 percent by weight to about 3 percent by weight manganese, about 1 percent by weight to about 6 percent by weight tin, about 0.1 percent by weight to about 4 percent by weight yttrium, and magnesium.

23 Claims, 5 Drawing Sheets

(56) References Cited

OTHER PUBLICATIONS

Oh-ishi K, Hono K, Shin KS. Effect of pre-aging and al addition on age-hardening and microstructure in mg-6 wt% zn alloys, *Mat Sci Eng A*, 2008, 496(1-2): 425-433.
Zhang DF, Shi GL, Zhao XB, et al., "Microstructure evolution and mechanical properties of mg-x%zn-1 %mn (x=4, 5, 6, 7, 8, 9) wrought magnesium alloys," *T Nonferr Metal Soc*, 2011, 21(1): 15-25.
Zhang D, Zhao X, Shi G, et al., "Effects of zn content and heat treatment on microstructures and mechanical properties of mg—zn—mn wrought magnesium alloys," *Rare Metal Mat Eng*, 2011, 40(3): 418-423.
Mendis CL, Bettles CJ, Gibson MA, et al., "An enhanced age hardening response in mg—sn based alloys containing zn," *Mat Sci Eng A*, 2006, 435 (163-171).
Van Der Planken J., "Precipitation hardening in magnesium-tin alloys," *J Mater Sci*, 1969, 4(10): 927-929 Sasaki TT, Ju JD, Hono K, et al., "Heat-treatable mg—sn—zn wrought alloy," *Scripta Mater*, 2009, 61(1): 80-83.
Sasaki TT, Oh-ishi K, Ohkubo T, et al., "Enhanced age hardening response by the addition of zn in mg—sn alloys," *Scripta Mater*, 2006, 55(3): 251-254.
Sasaki TT, Oh-ishi K, Ohkubo T, et al., "Effect of double aging and microalloying on the age hardening behavior of a mg—sn—znalloy," *Mat Sci Eng A*, 2011, 530(1-8).
Harosh S, Miller L, Levi G, et al., "Microstructure and properties of mg-5.6%sn-4.4%zn-2.1%al alloy," *J Mater Sci*, 2007, 42(24): 9983-9989.
Zhou H, Zeng X, Liu L, et al., "Effect of cerium on microstructures and mechanical properties of az61 wrought magnesium alloy," *J Mater Sci*, 2004, 39(23): 7061-7066.
Liu W, Cao F, Chang L, et al., "Effect of rare earth element ce and la on corrosion behavior of am60 magnesium alloy," *Corros Sci*, 2009, 51(6): 1334-1343.
Wang Y, Guan S, Zeng X, et al., "Effects of re on the microstructure and mechanical properties of mg—8zn—4a1 magnesium alloy," *Materials Science and Engineering: A*, 2006, 416(1): 109-118.
Xu D, Liu L, Xu Y, et al., "The effect of precipitates on the mechanical properties of zk60-y alloy," *Materials Science and Engineering: A*, 2006, 420(1): 322-332.
Li J, Yang Z, Liu T, et al., "Microstructures of extruded mg—12gd—1zn-0.5 zr and mg—12gd—4y—1zn-0.5 zr alloys," *Scripta Mater*, 2007, 56(2): 137-140.
Zou H, Zeng X, Zhai C, et al., "Effects of nd on the microstructure of za52 alloy," *Materials Science and Engineering: A*, 2005, 392(1): 229-234.
Liu XB, Chen RS, Han EH., "Effects of ageing treatment on microstructures and properties of mg—gd—y—zr alloys with and without zn additions," J *Alloy Compd*, 2008, 465(1-2): 232-238.
Zhang K, Li X-g, Li Y-j, et al., "Effect of gd content on microstructure and mechanical properties of mg—y—re—zr alloys," *Nonferr Metal Soc*, 2008, 18, Supplement 1(0): s12-s16.
Li DQ, Wang QD, Ding WJ., "Effects of heat treatments on microstructure and mechanical properties of mg—4y—4sm—0.5zr alloy," *Materials Science and Engineering a-Structural Materials Properties Microstructure and Processing*, 2007, 448(1-2): 165-170.
Shi GL., "Research on strengthening mechanism of mg—zn—mn wrought magnesium alloys," Place Published: Chongqing University, 2011.
Patterson AL, "The scherrer formula for x-ray particle size determination," *Phys Rev*, 1939, 56(10): 978-982.
Zhang D, Qi F, Shi G, et al., "Effects of mn content on microstructure and mechanical properties of mg—zn—mn wrought alloys," *Rare Metal Mat Eng*, 2010, 39(12): 2205-2210.
Bohlen J, Dobron P, Swiostek J, et al., "On the influence of the grain size and solute content on the ae response of magnesium alloys tested in tension and compression," *Mat Sci Eng A*, 2007, 462(1-2): 302-306.

* cited by examiner

MAGNESIUM-ZINC-MANGANESE-TIN-YTTRIUM ALLOY AND METHOD FOR MAKING THE SAME

FIELD

This application relates to magnesium alloys and, more particularly, to magnesium-zinc-manganese-tin-yttrium alloys.

BACKGROUND

Magnesium alloys are lightweight materials—they are 30 to 50 percent lighter than aluminum alloys and 70 percent lighter than steels. Additionally, magnesium alloys have good strength characteristics and stiffness, excellent damping and mechanical properties, and they resist corrosion. Therefore, magnesium alloys are used as structural materials in the aerospace, automobile and rail transportation industries, and are used in various products, such as household appliances.

Magnesium alloys are typically divided into two categories: cast magnesium alloys and wrought magnesium alloys. Cast magnesium alloys can have coarse grains and can exhibit compositional segregation. Therefore, cast magnesium alloys often fail to satisfy the stringent physical requirements of today's high-performance structural materials. Wrought magnesium alloys typically exhibit better mechanical properties, such as proof stress, tensile strength and elongation, as compared with cast magnesium alloys. Therefore, wrought magnesium alloys are often considered for use as high-performance structural materials, particularly when weight is an important consideration.

The common wrought magnesium alloys include the magnesium-aluminum-zinc series and the magnesium-zinc-zirconium series. AZ31 is a typical alloy of the magnesium-aluminum-zinc series—AZ31 has moderate strength, but poor high temperature strength performance. ZK60 is a typical alloy of the magnesium-zinc-zirconium series—ZK60 has excellent room temperature and high temperature strength performance, but is relatively expensive.

Accordingly, those skilled in the art continue with research and development efforts in the field of magnesium alloys.

SUMMARY

In one embodiment, the disclosed magnesium alloy may include (1) about 2 percent by weight to about 8 percent by weight zinc, (2) about 0.1 percent by weight to about 3 percent by weight manganese, (3) about 1 percent by weight to about 6 percent by weight tin, (4) about 0.1 percent by weight to about 4 percent by weight yttrium, and (5) magnesium.

In another embodiment, the disclosed magnesium alloy may consist essentially of (1) about 2 percent by weight to about 8 percent by weight zinc, (2) about 0.1 percent by weight to about 3 percent by weight manganese, (3) about 1 percent by weight to about 6 percent by weight tin, (4) about 0.1 percent by weight to about 4 percent by weight yttrium, and (5) magnesium, wherein said magnesium comprises a balance of said magnesium alloy.

In yet another embodiment, disclosed is a method for making a magnesium alloy. The method may include the steps of (1) forming a molten mass including about 2 percent by weight to about 8 percent by weight zinc, about 0.1 percent by weight to about 3 percent by weight manganese, about 1 percent by weight to about 6 percent by weight tin, about 0.1 percent by weight to about 4 percent by weight yttrium and magnesium; (2) cooling the molten mass to form a solid mass; (3) annealing the solid mass to form an annealed mass; and (4) extruding the annealed mass.

Other embodiments of the disclosed magnesium-zinc-manganese-tin-yttrium alloy and method for making the same will become apparent from the following detailed description, the accompanying drawings and the appended claims.

DETAILED DESCRIPTION

Disclosed is a magnesium alloy that includes magnesium (Mg), zinc (Zn), manganese (Mn), tin (Sn) and yttrium (Y). Without being limited to any particular theory, it is believed that the additions of yttrium and tin in the disclosed magnesium alloy may improve mechanical properties (vis-à-vis magnesium-aluminum-zinc series and magnesium-zinc-zirconium series magnesium alloys) by maintaining fine grains after melting and heat treatment, while also enhancing the hot-working temperature and reducing deformation resistance. Significantly, the disclosed magnesium alloys may be manufactured at much lower cost than magnesium-zinc-zirconium series magnesium alloys.

In a first embodiment, the disclosed magnesium alloy may include about 2 percent by weight to about 8 percent by weight zinc, about 0.1 percent by weight to about 3 percent by weight manganese, about 1 percent by weight to about 6 percent by weight tin, about 0.1 percent by weight to about 4 percent by weight yttrium. The balance of the magnesium alloy may be magnesium, as well as any present impurities. In one particular implementation of the first embodiment, the disclosed magnesium alloy may include at most about 0.15 percent by weight impurities (i.e., the impurity content).

As used herein, "impurities" refers to dissolved elements and inclusions other magnesium, zinc, manganese, tin and yttrium. Non-limiting examples of impurities include silicon, iron, copper and nickel.

In a second embodiment, the disclosed magnesium alloy may include about 5.0 percent by weight to about 6.3 percent by weight zinc, about 0.6 percent by weight to about 1.1 percent by weight manganese, about 2.0 percent by weight to about 4.4 percent by weight tin, about 0.1 percent by weight to about 1.3 percent by weight yttrium. The balance of the magnesium alloy may be magnesium, as well as any present impurities. In one particular implementation of the second embodiment, the disclosed magnesium alloy may include at most about 0.15 percent by weight impurities.

In a third embodiment, the disclosed magnesium alloy may include about 5.7 percent by weight zinc, about 0.9 percent by weight manganese, about 4.4 percent by weight tin, about 0.5 percent by weight yttrium. The balance of the magnesium alloy may be magnesium, as well as any present impurities. In one particular implementation of the third embodiment, the disclosed magnesium alloy may include at most about 0.15 percent by weight impurities.

Figure 1:
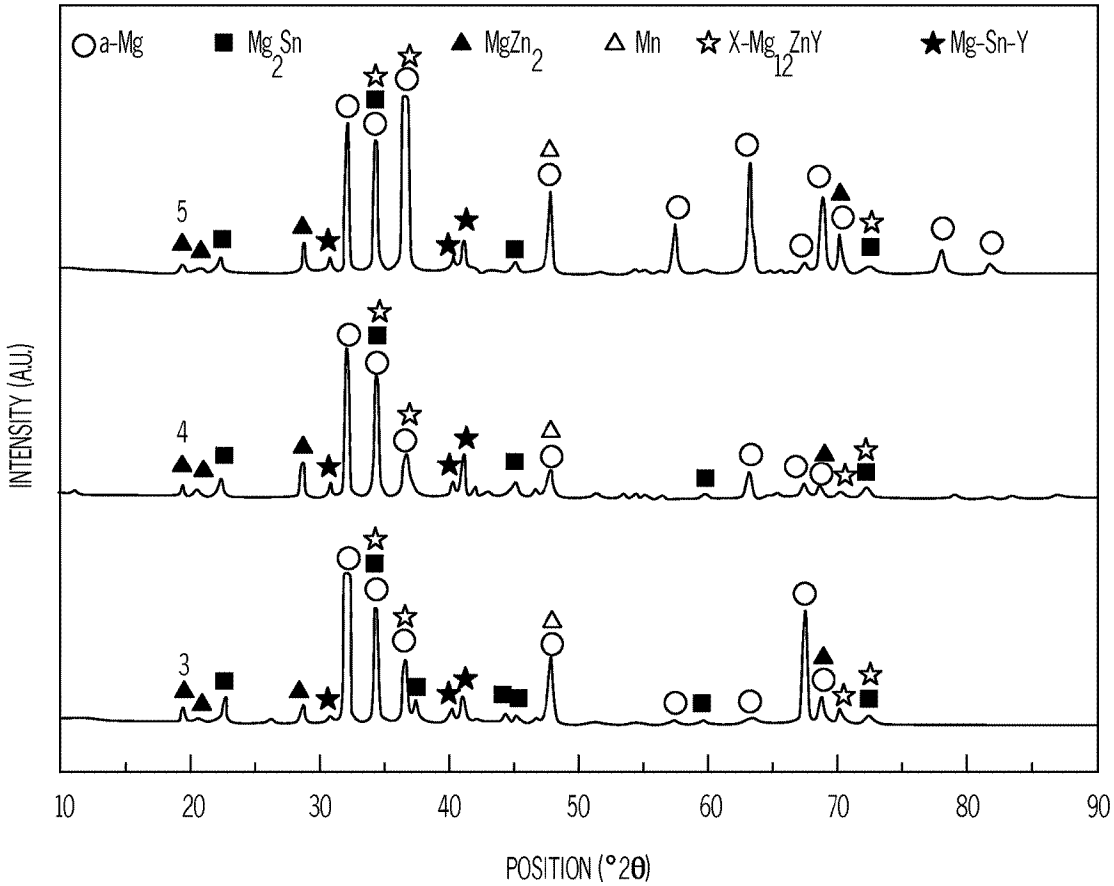
FIG. 1 is a graphical representation of the x-ray diffraction spectra of three example alloys of the disclosed magnesium-zinc-manganese-tin-yttrium alloy.
Figure 2:
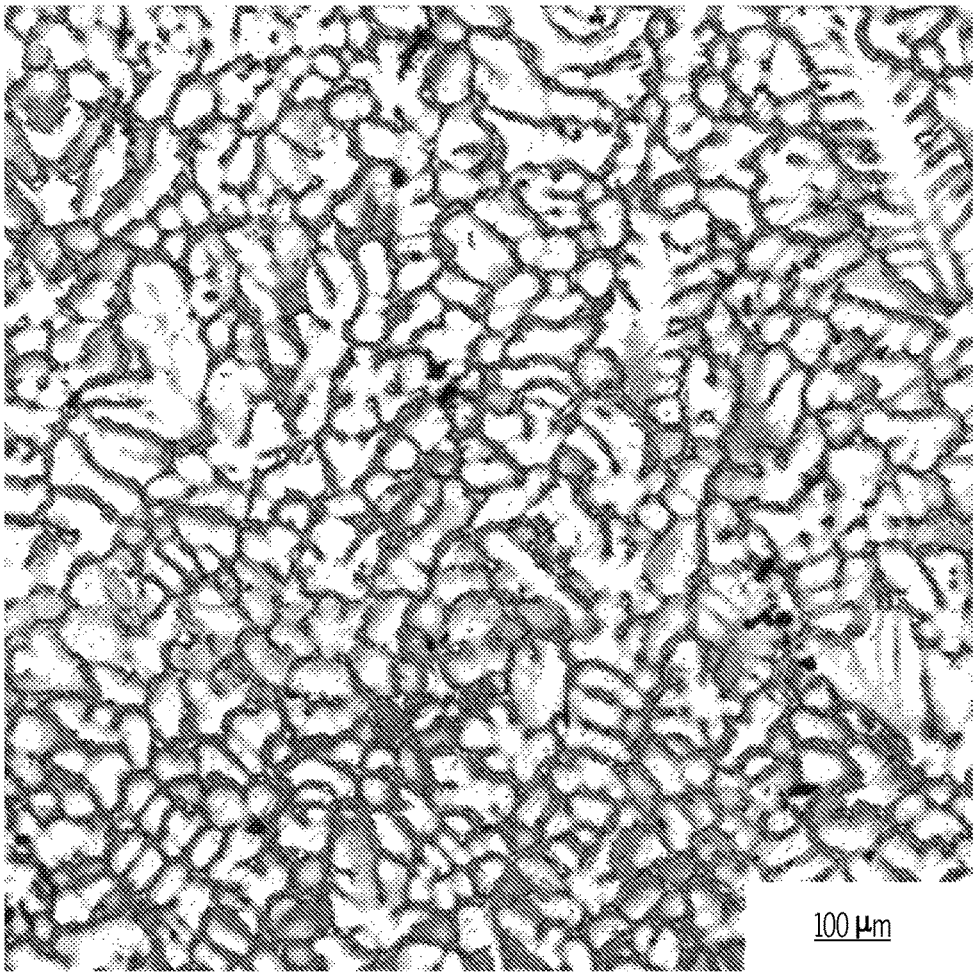
FIG. 2 is an optical micrograph of the as-cast microstructure of an example alloy of the disclosed magnesium-zinc-manganese-tin-yttrium alloy.
Figure 3:
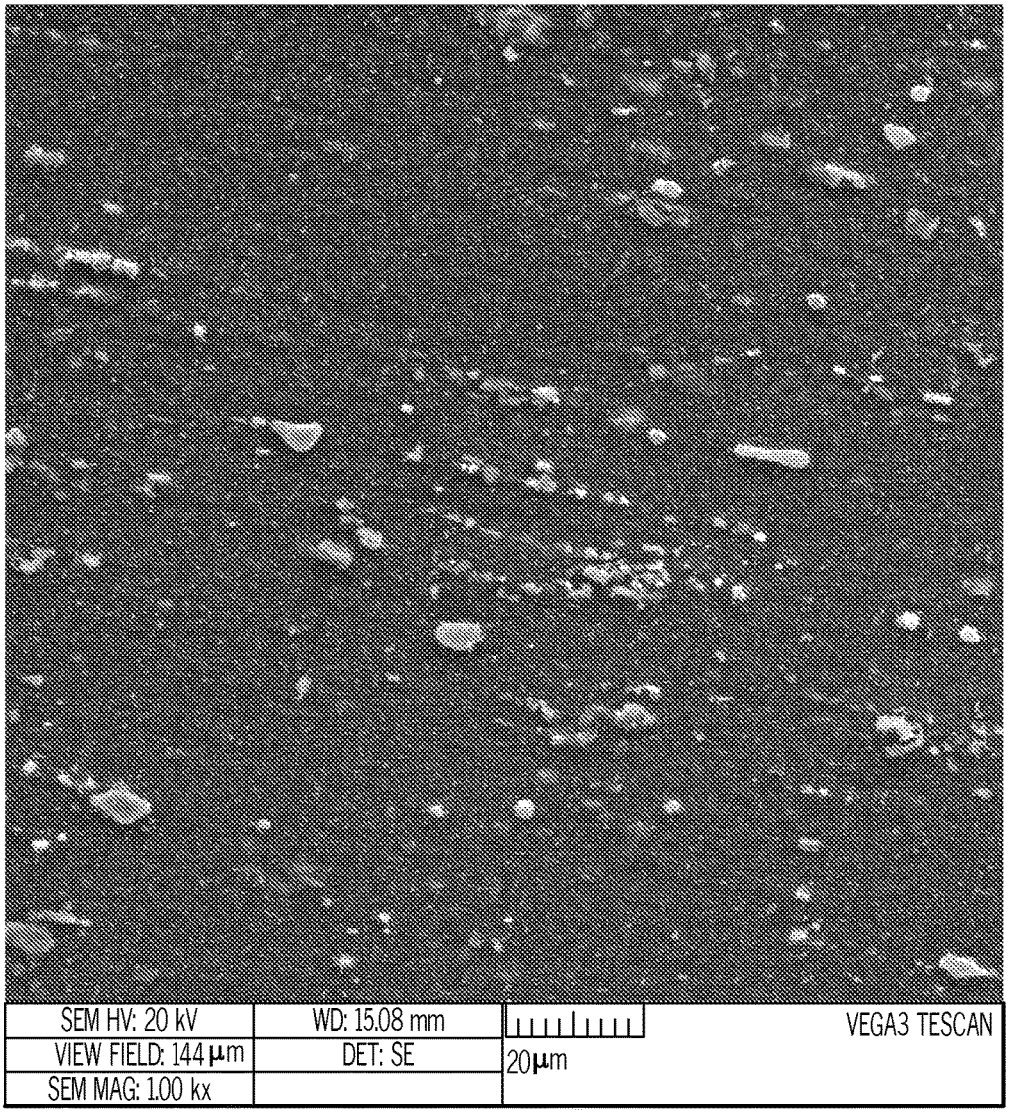
FIG. 3 is a scanning electron microscope micrograph of the as-extruded microstructure of an example alloy of the disclosed magnesium-zinc-manganese-tin-yttrium alloy.
Figure 4:
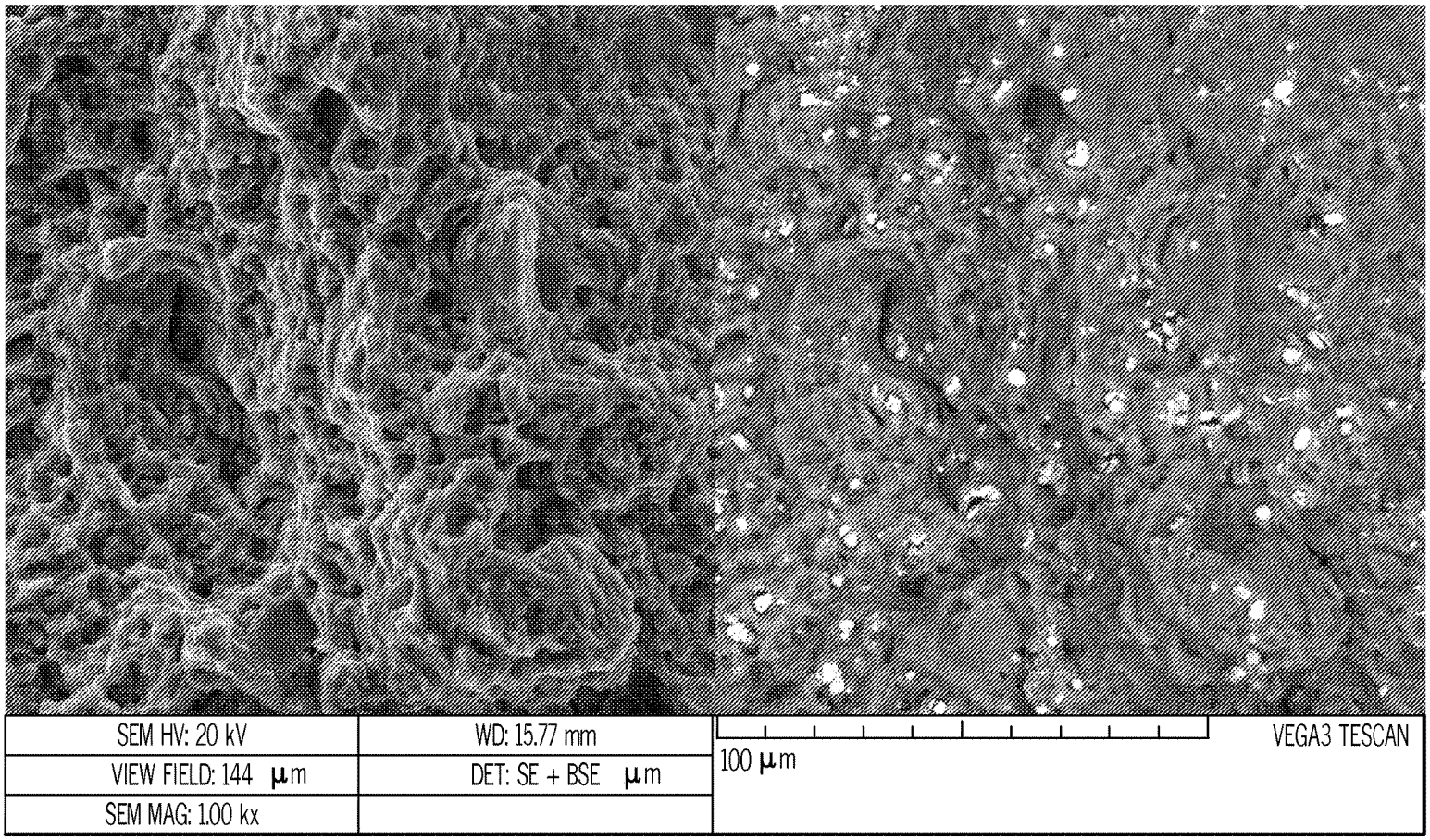
FIG. 4 shows scanning electron microscope micrographs of the fracture morphology of an extruded example alloy of the disclosed magnesium-zinc-manganese-tin-yttrium alloy.
Figure 5:
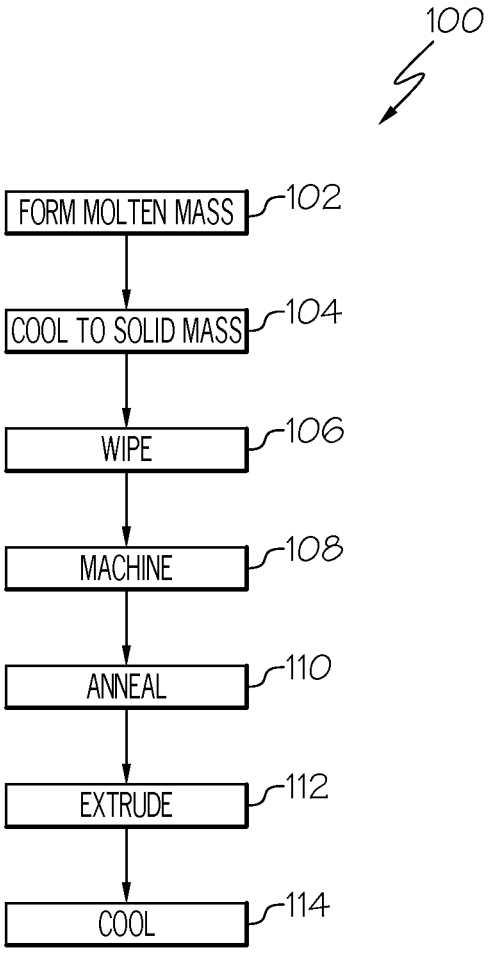
FIG. 5 is a flow chart depicting one embodiment of the disclosed method for making a magnesium alloy.

Referring to FIG. 5, one embodiment of the disclosed method 100 for making a magnesium alloy may begin at block 102 with the step of forming a molten mass. The molten mass may include magnesium, zinc, manganese, tin and yttrium. In one aspect of the disclosed method 100, the molten mass may include about 2 percent by weight to about 8 percent by weight zinc, about 0.1 percent by weight to about 3 percent by weight manganese, about 1 percent by weight to about 6 percent by weight tin, about 0.1 percent by weight to about 4 percent by weight yttrium, at most about 0.15 percent by weight impurities, and the balance magnesium.

The forming step (block 102) may be performed in a vacuum induction furnace by charging a crucible with a combination of metals and/or metal alloys required to achieve the desired composition. For example, the crucible may be charged with appropriate amounts of pure magnesium, pure zinc, pure tin, Mg-30% Y master alloy and Mg-5% Mn master alloy.

The furnace may heat the crucible and metals/metal alloys until a molten mass is formed. The molten mass may be stirred, such as for about 2 to about 5 minutes. Optionally, an inert gas blanket may cover the metals/metal alloys in the crucible during the forming step (block 102).

At block 104, the molten mass may be cooled to form a solid mass. Cooling may be effected with water (e.g., cold water). For example, during the cooling step (block 104), the crucible holding the molten mass may be removed from the furnace and immersed in water.

At block 106, any oxidization/crust formed on the solid mass may be wiped away. For example, the wiping step (block 106) may be performed with a cloth, a brush or the like.

At block 108, the solid mass may be machined to the desired size. For example, the machining step (block 108) may include passing the solid mass through a rolling mill until an extrudable size has been achieved.

At block 110, the solid mass may be annealed to form an annealed mass. The annealing step (block 110) may be performed homogeneously. For example, the annealing step (block 110) may include maintaining the solid mass at an elevated temperature (e.g., from about 410° C. to about 430° C.) for a period of time (e.g., from about 10 hour to about 14 hours).

At block 112, the annealed mass may be extruded (e.g., into bars). For example, the extruding step (block 112) may include an extruding temperature (e.g., about 350° C. to about 370° C.), an extruding speed (e.g., about 1 to about 2 meters per second (m/sec)), and a reduction ratio (e.g., 25).

At block 114, the extruded, annealed mass may be cooled. The cooling step (block 114) may include rapid cooling. For example, the cooling step (block 114) may include submerging the extruded, annealed mass into cold water. After cooling, the resulting magnesium alloy may optionally undergo solutionizing and aging.

Examples 1-5

Five magnesium alloys (Examples 1-5) were prepared using the following raw materials: pure Mg; pure Zn; pure Sn; Mg-30% Y master alloy; and Mg-5% Mn master alloy. The chemical compositions of Examples 1-5 are provided in Table 1.

TABLE 1

| Example | Mg (wt. %) | Zn (wt. %) | Mn (wt. %) | Sn (wt. %) | Y (wt. %) | Impurities (wt. %) |
|---|---|---|---|---|---|---|
| 1 | 91.05 | 5.12 | 0.62 | 3.07 | 0.11 | ≤0.15 |
| 2 | 90.99 | 5.02 | 0.61 | 2.90 | 0.45 | ≤0.15 |
| 3 | 88.52 | 5.69 | 0.90 | 4.38 | 0.50 | ≤0.15 |
| 4 | 88.39 | 6.21 | 0.97 | 3.45 | 0.97 | ≤0.15 |
| 5 | 90.11 | 5.5 | 1.03 | 2.09 | 1.26 | ≤0.15 |

For each of Examples 1-5, appropriate quantities of the raw materials were charged into a crucible and the crucible was heated in a vacuum induction furnace to form a molten mass. An argon blanket covered the surface of the molten mass in the crucible. The molten mass was stirred for 2 to 5 minutes and then quenched in cold water to yield an ingot. Any oxide/crust formed on the surface of the ingot was wiped away and the ingot was machined to a size suitable for extruding.

For each of Examples 1-5, the cooled and sized ingot was annealed at 420° C. for 12 hours and then extruded into bars. The extrusion parameters were as follows: (a) ingot temperature: 360° C.; (b) extruding cabin temperature: 350° C.; (c) mold temperature: 360° C.; (d) speed: 1 to 2 meters per minute; and (e) reduction ratio: 25. After extrusion, the bars were quickly cooled in cold water.

As shown in FIGS. 1-4, Examples 1-5 were evaluated by x-ray diffraction analysis, with an optical microscope, and with a scanning electron microscope. Additionally, the as-extruded ultimate yield strength ("UYS"), the ultimate tensile strength ("UTS") and the elongation ("EL") of Examples 1-5 were measured at room temperature. The results are provided in Table 2.

TABLE 2

| Example | UYS (Mpa) | UTS (Mpa) | EL (%) |
|---|---|---|---|
| 1 | 258 | 342 | 12.2 |
| 2 | 246 | 325 | 10.4 |
| 3 | 260 | 350 | 18.3 |
| 4 | 252 | 335 | 17.3 |
| 5 | 251 | 335 | 13.7 |

For comparison, the ultimate yield strength, the ultimate tensile strength, and the elongation of several magnesium alloys were also measured at room temperature. The results are provided in Table 3. AZ61 and ZK60 are prior art magnesium alloys.

TABLE 3

| Alloy | UYS (Mpa) | UTS (Mpa) | EL (%) |
|---|---|---|---|
| AZ61 | 230 | 290 | 11.0 |
| ZK60 | 230 | 320 | 11.0 |
| ZM61-2.0Y | 267 | 327 | 8.2 |
| ZMT614 | 255 | 324 | 10.7 |
| ZMT614-0.5Y | 260 | 350 | 18.3 |

Thus, the disclosed magnesium alloys may have significant commercial value.

Although various embodiments of the disclosed magnesium-zinc-manganese-tin-yttrium alloy and method for making the same have been shown and described, modifications may occur to those skilled in the art upon reading the specification. The present application includes such modifications and is limited only by the scope of the claims.

What is claimed is:

1. An extruded wrought magnesium alloy comprising:
about 2 percent by weight to about 8 percent by weight zinc;
about 0.1 percent by weight to about 3 percent by weight manganese;
about 1 percent by weight to about 6 percent by weight tin;
about 0.1 percent by weight to about 4 percent by weight yttrium; and
balance magnesium and impurities,
the extruded wrought magnesium alloy having an as-extruded ultimate tensile strength of at least 325 MPa and an as-extruded elongation of at least 10.4%.

2. The extruded wrought magnesium alloy of claim 1 wherein impurities comprise at most about 0.15 percent by weight of said magnesium alloy.

3. The extruded wrought magnesium alloy of claim 1:
wherein said zinc is at a concentration of about 5 percent by weight to about 6.3 percent by weight;
wherein said manganese is at a concentration of about 0.6 percent by weight to about 1.1 percent by weight;
wherein said tin is at a concentration of about 2 percent by weight to about 4.4 percent by weight; and
wherein said yttrium is at a concentration of about 0.1 percent by weight to about 1.3 percent by weight.

4. The extruded wrought magnesium alloy of claim 1:
wherein said zinc is at a concentration of about 5.7 percent by weight;
wherein said manganese is at a concentration of about 0.9 percent by weight;
wherein said tin is at a concentration of about 4.4 percent by weight; and
wherein said yttrium is at a concentration of about 0.5 percent by weight.

5. The extruded wrought magnesium alloy of claim 1 wherein said zinc is present at a concentration of about 5 percent by weight to about 6.3 percent by weight of said magnesium alloy.

6. The extruded wrought magnesium alloy of claim 1 wherein said manganese is present at a concentration of about 0.6 percent by weight to about 1.1 percent by weight of said magnesium alloy.

7. The extruded wrought magnesium alloy of claim 1 wherein said tin is present at a concentration of about 2 percent by weight to about 4.4 percent by weight of said magnesium alloy.

8. The extruded wrought magnesium alloy of claim 1 wherein said yttrium is present at a concentration of about 0.1 percent by weight to about 1.3 percent by weight of said magnesium alloy.

9. The extruded wrought magnesium alloy of claim 1 wherein said yttrium is at a concentration of 0.5 percent by weight to about 4 percent by weight.

10. The extruded wrought magnesium alloy of claim 1, wherein the extruded wrought magnesium alloy consists of:
about 2 percent by weight to about 8 percent by weight zinc;
about 0.1 percent by weight to about 3 percent by weight manganese;
about 1 percent by weight to about 6 percent by weight tin;
about 0.1 percent by weight to about 4 percent by weight yttrium; and
balance magnesium and impurities.

11. The extruded wrought magnesium alloy of claim 10, wherein the extruded wrought magnesium alloy consists of:
about 5 percent by weight to about 6.3 percent by weight zinc;
about 0.6 percent by weight to about 1.1 percent by weight manganese;
about 2 percent by weight to about 4.4 percent by weight tin;
about 0.1 percent by weight to about 1.3 percent by weight yttrium; and
balance magnesium and impurities.

12. The extruded wrought magnesium alloy of claim 10:
wherein said zinc is at a concentration of about 5.7 percent by weight;
wherein said manganese is at a concentration of about 0.9 percent by weight;
wherein said tin is at a concentration of about 4.4 percent by weight; and
wherein said yttrium is at a concentration of about 0.5 percent by weight.

13. The extruded wrought magnesium alloy of claim 10 wherein impurities are at most about 0.15 percent by weight of said magnesium alloy.

14. A method for making a magnesium alloy comprising steps of:
forming a molten mass comprising the magnesium alloy composition of claim 1;
cooling said molten mass to form a solid mass;
annealing said solid mass to form an annealed mass; and
extruding said annealed mass.

15. The method of claim 14 wherein said molten mass comprises at most about 0.15 percent by weight of said impurities.

16. The method of claim 14 wherein said forming step is performed in a vacuum induction furnace.

17. The method of claim 14 wherein said molten mass is under an inert gas blanket during said forming step.

18. The method of claim 14 wherein said annealing step comprises maintaining said solid mass at a temperature ranging from about 410° C. to about 430° C. for about 10 hours to about 14 hours.

19. The method of claim 14 wherein said extruding step is performed at a temperature ranging from about 350° C. to about 370° C.

20. The method of claim 19 wherein said extruding step comprises a speed ranging from about 1 m/min to about 2 m/min.

21. The method of claim 14 further comprising cooling said extruded, annealed mass.

22. The method of claim 14 wherein:
said zinc is at a concentration of about 5 percent by weight to about 6.3 percent by weight;
said manganese is at a concentration of about 0.6 percent by weight to about 1.1 percent by weight;
said tin is at a concentration of about 2 percent by weight to about 4.4 percent by weight; and
said yttrium is at a concentration of about 0.1 percent by weight to about 1.3 percent by weight.

23. The method of claim 14 wherein:
said zinc is at a concentration of about 5.7 percent by weight;
said manganese is at a concentration of about 0.9 percent by weight;

said tin is at a concentration of about 4.4 percent by weight; and said yttrium is at a concentration of about 0.5 percent by weight.

* * * * *